US008191381B2

(12) United States Patent
Kim et al.

(10) Patent No.: US 8,191,381 B2
(45) Date of Patent: Jun. 5, 2012

(54) OUTDOOR UNIT OF AIR-CONDITIONER AND FAN USED THEREFOR

(75) Inventors: Jung Hoon Kim, Seoul (KR); Kak Joong Kim, Seoul (KR); Yong Sang Yoon, Seoul (KR); Dong Soo Moon, Seoul (KR); Si Young Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 692 days.

(21) Appl. No.: 12/361,088

(22) Filed: Jan. 28, 2009

(65) Prior Publication Data

US 2009/0188274 A1 Jul. 30, 2009

(30) Foreign Application Priority Data

Jan. 30, 2008 (KR) ..... 10-2008-0009714

(51) Int. Cl.
*F25D 17/06* (2006.01)

(52) U.S. Cl. ..... 62/428; 62/498

(58) Field of Classification Search ..... 62/426, 62/428, 262, 498, 419; 416/219 R, 223 R, 416/244 R; 415/119, 220
See application file for complete search history.

(56) References Cited

U.S. PATENT DOCUMENTS

| | | | | |
|---|---|---|---|---|
| 4,943,209 | A * | 7/1990 | Beehler | 416/204 R |
| 4,971,520 | A * | 11/1990 | Van Houten | 416/169 A |
| 5,097,678 | A * | 3/1992 | Aubuchon | 62/506 |
| 5,236,306 | A * | 8/1993 | Hozak | 416/93 R |
| 5,895,206 | A * | 4/1999 | Chuang et al. | 416/189 |
| 7,086,825 | B2 * | 8/2006 | Wang et al. | 415/58.7 |
| 2003/0182954 | A1 * | 10/2003 | Parker et al. | 62/186 |
| 2003/0209024 | A1 * | 11/2003 | Lee | 62/262 |
| 2004/0165986 | A1 * | 8/2004 | Parker et al. | 415/220 |
| 2005/0144975 | A1 * | 7/2005 | Fuchikami et al. | 62/508 |
| 2005/0147496 | A1 * | 7/2005 | Uselton et al. | 416/223 R |
| 2005/0207894 | A1 * | 9/2005 | Park et al. | 416/223 R |
| 2005/0281672 | A1 * | 12/2005 | Parker et al. | 416/95 |
| 2006/0216147 | A1 * | 9/2006 | Park | 415/220 |
| 2007/0256439 | A1 * | 11/2007 | Eom et al. | 62/262 |
| 2008/0050240 | A1 * | 2/2008 | Tanigawa | 416/223 R |
| 2008/0084140 | A1 * | 4/2008 | Kim | 310/67 R |
| 2008/0127671 | A1 * | 6/2008 | Kim et al. | 62/467 |
| 2008/0159872 | A1 * | 7/2008 | Park et al. | 416/244 R |

FOREIGN PATENT DOCUMENTS

| | | |
|---|---|---|
| EP | 1 610 068 | 12/2005 |
| JP | 58-044297 | 3/1983 |
| JP | 58-044298 | 3/1983 |

OTHER PUBLICATIONS

European Search Report issued in EP Application No. 09151163.4 dated May 23, 2011.

* cited by examiner

*Primary Examiner* — Mohammad Ali
(74) *Attorney, Agent, or Firm* — KED & Associates, LLP

(57) ABSTRACT

An outdoor fan for an air-conditioner is provided to reduce unnecessary energy consumption and noise generated during an operation by reducing a side circulation flow generated when the fan rotates. The outdoor fan may include a hub shaft with a side hole, and rotary blades that convert rotary power received from the hub shaft into a pressure difference. The hub shaft may include a main plate unit perpendicular to the hub shaft and, positioned at a front side as compared to a virtual plane that includes the side hole, and the main plate unit to cover at least a portion of the hub shaft.

13 Claims, 5 Drawing Sheets

OUTDOOR UNIT OF AIR-CONDITIONER AND FAN USED THEREFOR

This application claims priority from Korean Application No. 10-2008-0009714, filed Jan. 30, 2008, the subject matter of which is incorporated herein by reference.

BACKGROUND

1. Field

Embodiments of the present invention may relate to an outdoor unit of an air-conditioner.

2. Background

Air-conditioners may adjust a state of air such that air in a certain space is maintained for people to live in an agreeable condition. The air-conditioner may manage to maintain temperature and moisture of the space at a certain level by absorbing or releasing heat in the space. The air-conditioner may externally release heat absorbed from the space and/or absorb heat from the exterior, and the air-conditioner may use an outdoor unit to perform such functions.

The outdoor unit may exchange heat with the outside. In order to effectively perform heat exchanging, air in an interior of the outdoor unit may be properly exchanged with external air to maintain a temperature difference of a certain level between a heat exchanger within the outdoor unit and air within the outdoor unit. A device, such as a fan, may be used for circulating air by externally discharging air within the outdoor unit. The fan may form a pressure difference for air circulation upon receiving rotary power from a driving source. Efficiency of discharging air, noise, vibration, and the like may differ depending on shape or structure of the fan. Accordingly, the shape of the fan may be determined based on fluid mechanics. The fan may be coupled to a driving shaft of a driving source so operation efficiency for the coupling may be considered in designing the shape of the fan. An effective configuration of the fan may be determined based on factors such as energy efficiency, vibration, noise, operation efficiency, or the like.

BRIEF DESCRIPTION OF THE DRAWINGS

Arrangements and/or embodiments may be described in detail with reference to the following drawings in which like reference numerals refer to like elements and wherein.

DETAILED DESCRIPTION

Figure 1:
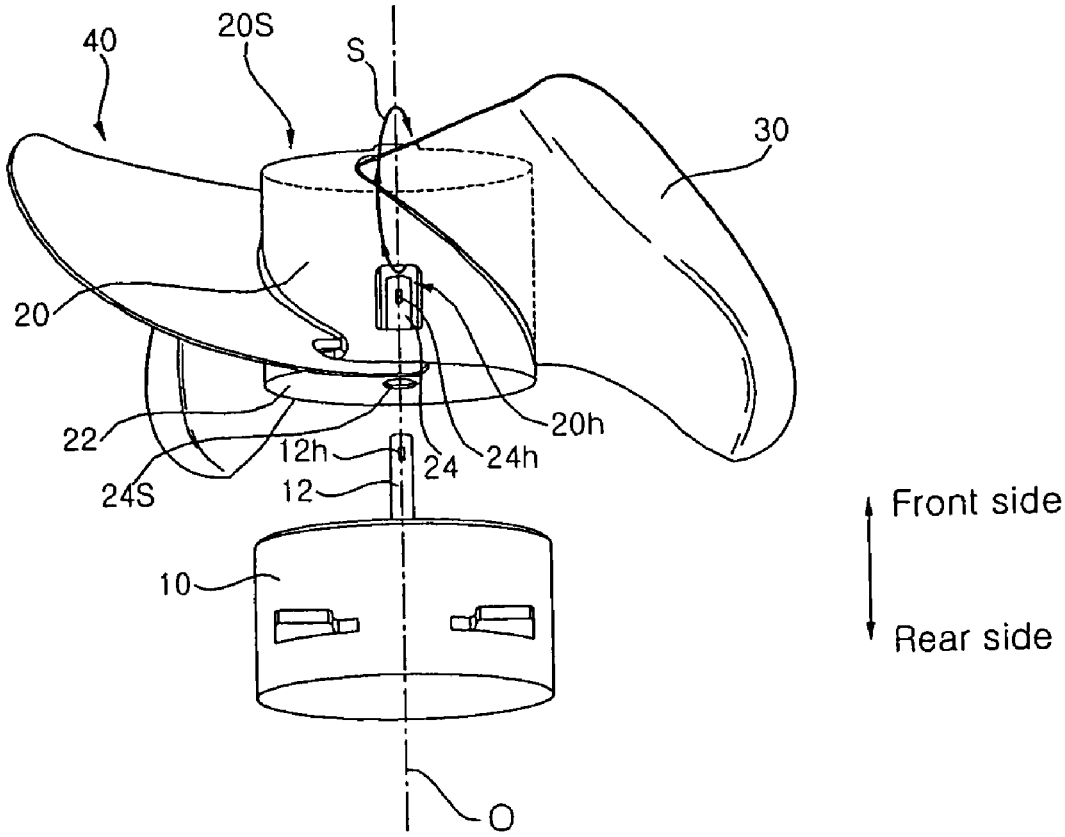
FIG. 1 is a separated perspective view of an outdoor fan for an air-conditioner that generates a side circulation flow and a driving source.

FIG. 1 is a perspective view of a fan that may be used for an outdoor unit for an air-conditioner and a driving source that transfers rotary power (or turning force) to the fan. Other arrangements may also be provided.

FIG. 1 shows that a fan 40 may include a hub shaft 20 and rotary blades 30.

A driving shaft 12 of a driving source 10 that generates rotary power may be inserted into a rear side of the hub shaft 20. The hub shaft 20 may include a side hole **20*h*, a main plate unit 22 and a projection 24. The side hole 20*h* may allow coupling of the driving shaft 12 and the hub shaft 20 so the hub shaft 20 can rotate in conjunction with the driving shaft 12 upon receiving the rotary power generated by the driving shaft 12. The main plate unit 22 may close the rear side of the hub shaft 20. The projection 24 may project from the main plate unit 22 toward a front side of the fan and the main plate unit 22 may have a central hole 24S allowing the driving shaft 12 to be inserted therein. An opening 20S may also be provided at the front side of the main plate unit 22**.

The rotary blades 30 may be fixed to the hub shaft 20. When the hub shaft 20 rotates around a virtual axis (○) extending in a lengthwise direction of the hub shaft 20 upon receiving rotary power from the driving source 10, the rotary blades 30 may also rotate in conjunction with the hub shaft 20 to form a pressure difference between a front side and a rear side in the direction of the virtual axis (○), thus discharging air to the front side.

The coupling of the hub shaft 20 and the driving shaft 12 will now be described in more detail. A first coupling hole **24*h* may be formed at a side of the projection 24, and a second coupling hole 12*h* may be formed at a side of the driving shaft 12 to correspond to the first coupling hole 24*h*. The outdoor fan 40 may further include a driving shaft coupling member (not shown) to couple the hub shaft 20 and the driving shaft 12 through the first coupling hole 24*h* and the second coupling hole 12*h*. The driving shaft coupling member may be a coupling member that couples mechanical members, such as a bolt, a pin, or the like. In order for the driving shaft coupling member to couple the hub shaft 20 and the driving shaft 12 through the first coupling hole 24*h* and the second coupling hole 12*h*, a tool may be received up to the projection 24. The side hole 20*h* may be formed at the side of the hub shaft 20 in order to secure a space for coupling the hub shaft 20 and the driving shaft 12 by using the tool. The side hole 20*h* may improve efficiency of the coupling operation of the fan 40 and the driving source 10**.

A side circulation flow generated when the fan 40 rotates may now be described.

When the fan 40 rotates, a pressure difference may be formed between the front side and the rear side, thereby discharging air to the front side of the fan 40. The front pressure may be relatively reduced at a center of the hub shaft, and the air may be lowered. Because of the presence of the opening 20S formed at the front side of the hub shaft 20, air may be lowered through the opening 20S and then discharged through the side hole **24*h*. The discharged air may flow to the front side because of the pressure difference between the front side and the rear side formed by the rotary blades 30, and then lowered at the center of the hub shaft 20. This process may be repeatedly performed. The generated air flow through the center of the hub shaft 20 and the side hole 20*h* in the process of rotation of the fan 40** may be called a side circulation flow (S).

The side circulation flow (S) may be a flow circulating within the outdoor unit that does not contribute to heat exchange between the outdoor unit and an external space. Accordingly, energy consumed for generation of the side circulation flow may be a sort of energy loss. Thus, as the side circulation flow (S) increases, energy loss may be unnecessarily increased and energy efficiency may be degraded. In addition, when the side circulation flow (S) increases, the rotation speed of the fan 40 may increase to maintain a required amount of air discharge, resulting in an increase in vibration and noise when the fan 40 operates.

An outdoor fan for the air-conditioner that may overcome the above-mentioned problem(s) may now be described with reference to FIGS. 2 to 4.

Figure 2:
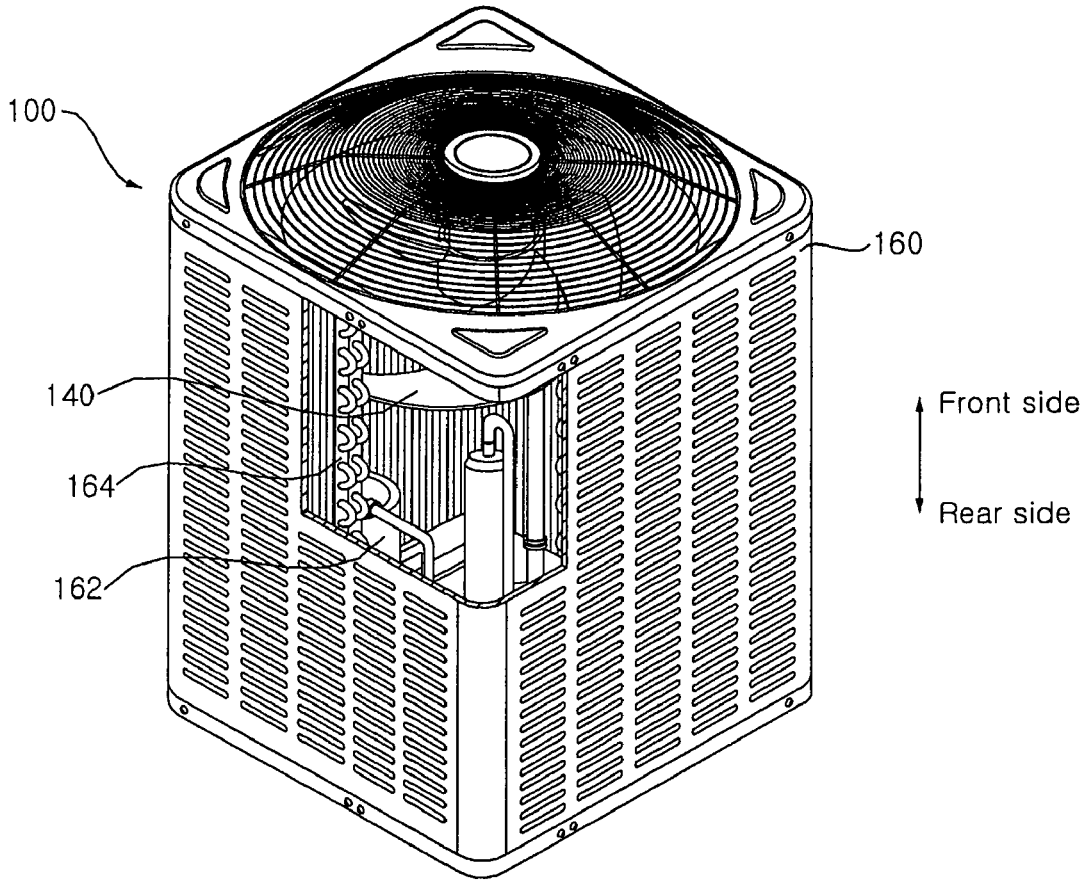
FIG. 2 is a perspective view of an outdoor unit for an air-conditioner according to an example embodiment of the present invention.

FIG. 2 shows an outdoor unit 100 for an air-conditioner. The outdoor unit 100 may include a cabinet 160, a compressor 162, a heat exchanger 164, a fan 140 and a driving source 110. The cabinet 160 may form an external appearance of the outdoor unit 100. The compressor 162 may be disposed within the cabinet 160 to compress a refrigerant. The heat exchanger 164 may be coupled with the compressor 162 to heat-exchange between the compressed refrigerant and outdoor air. The fan 140 may externally discharge indoor air that has absorbed heat from the heat exchanger 164. The driving source 110 may transfer rotary power to the fan 140 to rotate the fan 140.

The outdoor fan 140 with a reduced side circulation flow (S) as described above may now be described with reference to FIG. 3.

Figure 3:
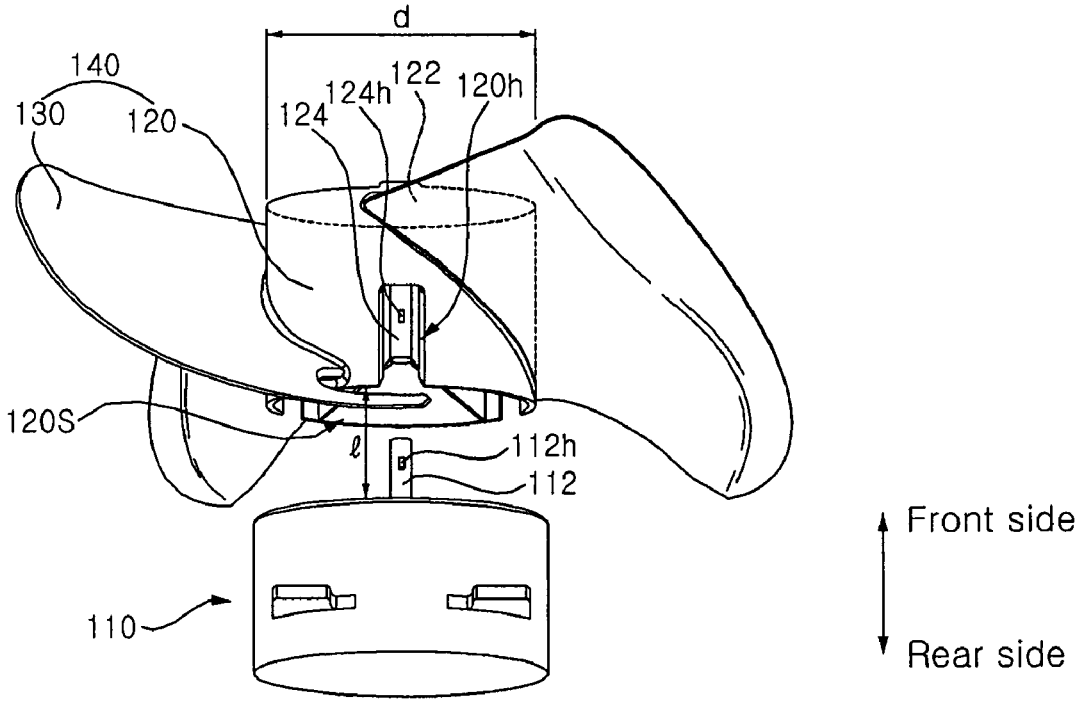
FIG. 3 is a separated perspective view of an outdoor fan for an air-conditioner and a driving source according to an example embodiment of the present invention.
Figure 4:
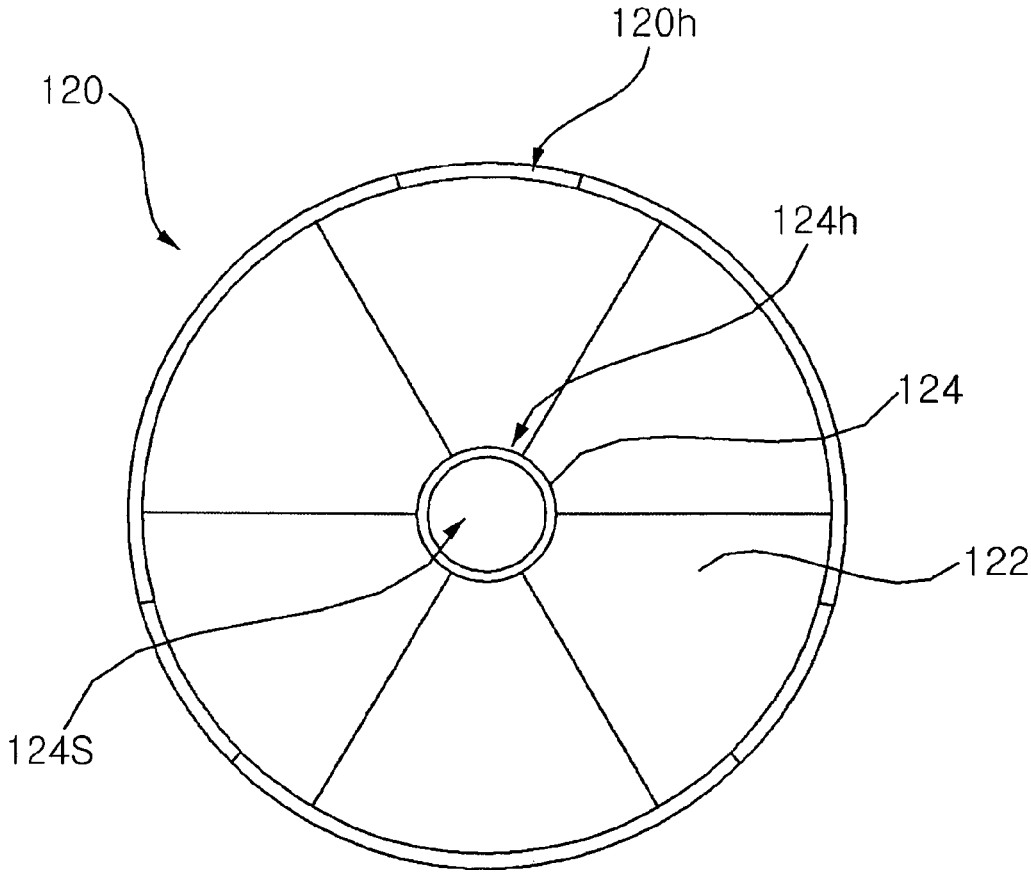
FIG. 4 is a plan view of a hub shaft of a fan according to an example embodiment of the present invention.

FIG. 3 is a separated perspective view of an outdoor fan for an air-conditioner and a driving source according to an example embodiment of the present invention. Other embodiments and configurations are also within the scope of the present invention.

The fan 140 includes a hub shaft 120 and rotary blades 130.

A driving shaft 112 of the driving source 110 that generates rotary power may be inserted into a rear side of the hub shaft 120. The hub shaft 120 may include a side hole **120*h*, a main plate unit 122 and a projection 124. The side hole 120*h* may allow coupling of the driving shaft 112 and the hub shaft 120 so the hub shaft 120 can rotate in conjunction with the driving shaft 112 upon receiving rotary power generated by the driving shaft 112. The main plate unit 122 including the side hole 120*h* may be positioned in front of a virtual plane perpendicular to the hub shaft 120 and may cover at least a portion of the hub shaft 120 (and more preferably an entire region of the hub shaft 120) in order to prevent air flow through a center of the hub shaft 120. Although the main plate unit 122 covers a portion of the hub shaft 120, an effect of reducing the side circulation flows can be obtained, so the main plate unit 122 may not necessarily cover the entire region of the hub shaft 120. The projection 124 may project from the main plate unit 122 toward the rear side and have a central hole 124S that allows the driving shaft 112 to be inserted therein. An opening 120S may be formed at the rear side of the main plate unit 122 of the hub shaft 120**.

The rotary blades 130 may be fixed to the hub shaft 120. When the hub shaft 120 rotates around a virtual axis (○) extending in a lengthwise direction of the hub shaft 120 upon receiving the rotary power from the driving source 110, the rotary blades 130 may rotate in conjunction with the hub shaft 120 to form a pressure difference between the front side and the rear side in the direction of the virtual axis (○), thus discharging air to the front side.

The coupling of the hub shaft 120 and the driving shaft 112 may now be described. A first coupling hole **124*h* may be formed at a side of the projection 124, and a second coupling hole 112*h* may be formed at a side of the driving shaft 112 such that the second coupling hole 112*h* corresponds to the first coupling hole 124*h*. The outdoor fan 140 may include a driving shaft coupling member (not shown) to couple the hub shaft 120 and the driving shaft 112 through the first coupling hole 124*h* and the second coupling hole 112*h*. The driving shaft coupling member may be a general coupling member that couples mechanical members, such as a bolt, a pin, or the like. In order for the driving shaft coupling member to couple the hub shaft 120 and the driving shaft 112 through the first coupling hole 124*h* and the second coupling hole 112*h*, a tool may be received up to the projection 124, and the side hole 120*h* formed at the side of the hub shaft 120** may be a space to receive the tool.

The side circulation flow (S) being reduced in the fan 140 may now be described. When the fan 140 rotates, a pressure difference may be provided between the front side and the rear side, thereby making air discharge to the front side. The pressure difference at the central side may be reduced, so air may descend to the rear side in the direction of the virtual axis (○). The main plate unit 122 provided at the hub shaft 120 and including the side hole **120*h* may be positioned at a front side as compared to a virtual plane (hereafter referred to as 'plane') perpendicular to the hub shaft 120, so a position of the flow path of the side circulation flow may be closed by the main plate unit 122. Accordingly, the air that descends backwardly in the direction of the virtual axis (○) may not flow any further due to the main plate unit 122. There may not be any holes that serve as an outlet to form a flow path of the side circulation flow like the side hole 120*h* at the front side of the main plate unit 122. Accordingly, if the main plate unit 122 covers at least a portion of the hub shaft 120, the flow of descending air may be retarded. If the main plate unit 122 covers the entire hub shaft 120**, there may be no space for forming the flow path of the side circulation flow, resulting in no generation of the side circulation flow.

Positioning the main plate unit 122 at the front side of the plane may prevent the side circulation flow, and a vortex may be generated at the space formed by the main plate unit 122 and the hub shaft 120. The main plate unit 122 may be positioned to be inclined to the front side. Positioning the main plate unit 122 at the front side of the plane may obtain an intended effect, so embodiments of the present invention are not limited to the main plate unit 122 positioned to be inclined to the front side as shown in FIG. 3.

Optimization of a distance (l) between the hub shaft 120 and the driving source 110 may now be described.

When the fan 140 rotates, a relatively low pressure may be formed at the rear side of the rotary blades 130, and air may be introduced via the rotary blades 130 and discharged to the front side. Low pressure may be formed by the rotary blades 130 so a relatively high pressure, compared to the rear side of the rotary blades 130, may be formed near the virtual axis (○) behind the hub shaft 120 that receives a relatively smaller influence of the rotary blades 130. Accordingly, air may flow toward the virtual axis (○) between the hub shaft 120 and the driving source 110. The presence of the opening 120S formed at the rear side of the main plate unit 122 may cause generation of vortex or a circulation flow due to the air that has flowed in the opening 120S. Such a vortex may be a flow that is not involved in externally discharging air in the outdoor unit 100, so energy consumed for generation of such flow may make an energy loss. As the amount of the flow increases, more noise may be generated. In order to reduce such a vortex, preferably no gap may be provided between the hub shaft 120 and the driving source 110 to prevent air from being introduced between the hub shaft 120 and the driving source 110. However, the driving source 110 may be fixed while the hub shaft 120 rotates, so the driving source 110 and the hub shaft 120 may not be physically integrally formed, and it may be difficult to design the hub shaft 120 and the driving source 110 without any gap therebetween. This may be performed through precise designing that may degrade an operation efficiency, and manufacturing of an outdoor unit through such precise designing may not be preferred in terms of economic efficiency. As a result, a distance (l) may exist between the driving source 110 and the hub shaft 120, and preferably a shorter distance may be permitted within a certain size range.

Meanwhile, if the distance (l) between the driving source 110 and the hub shaft 120 increases, a sectional area of the space between the driving source 110 and the hub shaft 120 may increase, resulting in more air being introduced therebetween. More of the vortex may be generated to increase the amount of energy consumption and noise. The distance (l) may be secured by more than a proper level based on efficiency of operation of coupling the fan 140 and the driving source 110 and economic efficiency. Therefore, the distance (l) may be selected to a proper level to prevent unnecessary energy consumption and an increase of noise while considering operation efficiency.

Figure 5:
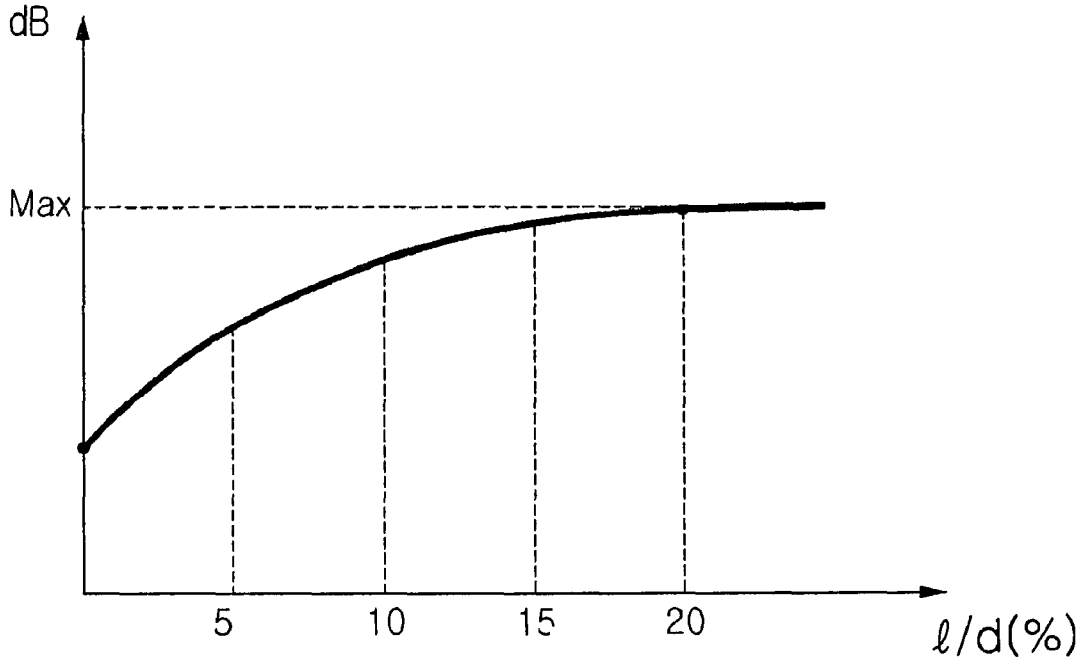
FIG. 5 is a graph showing an amount of noise based on a distance between a driving source and a hub shaft.

FIG. 5 is a graph showing an amount of noise based on a distance between a driving source and a hub shaft. The experimentation results shown in FIG. 5 may show that if the distance (l) increases, the amount of generated noise may increase. However, if the distance (l) is longer by a certain distance, (i.e., larger than 20% of a diameter (d) of the hub shaft 120), then noise caused by the generated circulation flow may not increase any more, whereas the length of the driving shaft 112 coupled with the hub shaft 120 may increase. The increase in the length of the driving shaft 112 may increase vibration, improve operation efficiency, but eccentricity of the driving shaft 112 may also increase regardless of vortex, increasing noise due to length of the driving shaft. Consequently, the distance (l) may be within the range of 20% of the diameter (d) of the hub shaft.

Embodiments of the present invention may provide an outdoor fan for an air-conditioner capable of increasing an operation efficiency, improving an energy efficiency by reducing a side circulation flow, and reducing vibration, noise, and/or the like.

An outdoor fan may be provided for an air-conditioner that includes: a hub shaft with a side hole, and rotary blades that convert rotary power received from the hub shaft into a pressure difference. The hub shaft may include a main plate unit perpendicular to the hub shaft and, positioned at a front side as compared with a virtual plane including the side hole, and covering at least a portion of the hub shaft. The side hole may be used for coupling a driving shaft of a driving source and the hub shaft such that the driving shaft is inserted from a rear side of the hub shaft and the hub shaft may receive the rotary power from the driving shaft. The hub shaft may include an opening formed at a rear side of the main plate unit of the hub shaft. The hub shaft may also include a projection with a central hole formed at the center of the opening to allow the driving shaft of the driving source to be inserted thereunto. A first coupling hole may be provided at the side of the projection, a second coupling hole may be provided at a position corresponding to the first coupling hole at the side of the driving shaft. A driving shaft coupling member may also be provided to couple the driving shaft and the hub shaft via the first and second coupling holes.

An outdoor unit may be provided for an air-conditioner that includes: a cabinet, a driving source disposed within the cabinet and to generate rotary power, a hub shaft disposed in front of the driving source to receive rotary power from the driving source, and a fan forming a pressure difference received from the hub shaft. The distance between the driving source and the fan may be 20% or less than the diameter of the hub shaft. The hub shaft may include a side hole serving as a space for coupling the driving shaft and the hub shaft. The fan may further include a main plate unit perpendicular to the hub shaft, positioned at a front side as compared with a virtual plane including the side hole. The main plate unit may cover at least a portion of the hub shaft.

Embodiments of the present invention may have advantages. For example, an operation efficiency of coupling the driving shaft of the driving source and the fan may be increased. Side circulation flow generated at the side of the fan may be reduced so as to avoid unnecessary energy consumption. Additionally, a rotation speed of the fan for maintaining performance of a required level may be lowered to reduce noise and vibration. Still further, unnecessary energy consumption may be reduced by optimizing a distance between the fan and the driving source, and vibrations that may be generated due to the increase in the distance between the fan and the driving source may be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor fan for an air-conditioner, comprising:

a hub shaft having a side hole;

rotary blades coupled to the hub shaft to convert rotary power received from the hub shaft into a pressure difference to discharge air;

a main plate unit, substantially perpendicular to the hub shaft, and positioned near an end of the hub shaft in which air is discharged, and without being on a plane of the side hole, and the main plate unit to cover at least a portion of the hub shaft; and a projection that projects from the main plate unit toward a rear side, wherein the hub shaft has an opening formed at a rear side of the main plate unit, wherein the projection has a first coupling hole formed at a side of the projection corresponding to the side hole, and a central hole formed at a center of the opening to receive a driving shaft of a driving source.

2. The outdoor fan of claim 1, wherein the driving shaft has a second coupling hole formed at a side of the driving shaft and at a position corresponding to the first coupling hole, and the outdoor fan further comprising a driving shaft coupling member to couple the driving shaft and the hub shaft via the first coupling hole and the second coupling hole.

3. The outdoor fan of claim 1, wherein a distance between the driving source and the hub shaft is 20% or less than a diameter of the hub shaft.

4. The outdoor fan of claim 1, wherein the main plate unit is provided between a front end of the hub shaft and the plane of the side hole.

5. An outdoor unit for an air-conditioner comprising:

a driving source to generate a rotary power, the driving source including a driving shaft;

a hub shaft having a side hole;

rotary blades coupled to the hub shaft to convert the rotary power received from the hub shaft into a pressure difference to discharge air;

a main plate unit, substantially perpendicular to the hub shaft, and positioned near an end of the hub shaft in which air is discharged and without being on a plane of the side hole, and the main plate unit to cover at least a portion of the hub shaft; and a projection that projects from the main plate unit toward a rear side, wherein the hub shaft has an opening formed at a rear side of the main plate unit, wherein the projection has a first coupling hole formed at a side of the projection corresponding to the side hole, and a central hole formed at a center of the opening to receive the driving shaft.

6. The outdoor unit of claim 5, wherein the driving shaft has a second coupling hole formed at a side of the driving shaft and at a position corresponding to the first coupling hole, and the outdoor unit further comprising a driving shaft coupling member to couple the driving shaft and the hub shaft via the first coupling hole and the second coupling hole.

7. The outdoor unit of claim 5, wherein a distance between the driving source and the hub shaft is 20% or less than a diameter of the hub shaft.

8. The outdoor unit of claim 5, wherein the main plate unit is provided between a front end of the hub shaft and the side hole.

9. An outdoor fan for an air-conditioner, comprising:

a driving source having a driving shaft to provide a rotary power;

a hub shaft having a side hole, a main plate unit and a projection; and rotary blades coupled to the hub shaft to convert the rotary power into a pressure difference to discharge air, wherein the main plate unit is substantially perpendicular to the hub shaft without being on a plane of the side hole, and is positioned near an end of the hub shaft in which air is discharged, and the main plate unit to cover a portion of the hub shaft, wherein the projection extends from the main plate unit toward a rear side of the hub shaft, wherein the projection has a first coupling hole formed at a side of the projection that corresponds to the side hole, wherein an opening of the hub shaft is formed at a side of the main plate unit, and the projection includes a central hole to receive the driving shaft.

10. The outdoor fan of claim 9, wherein the driving shaft has a second coupling hole formed at a side of the driving shaft to correspond to the first coupling hole of the projection.

11. The outdoor fan of claim 10, further comprising a driving shaft coupling member to couple the driving shaft and the hub shaft via the first coupling hole and the second coupling hole.

12. The outdoor fan of claim 9, wherein a distance between the driving source and the hub shaft is 20% or less than a diameter of the hub shaft.

13. The outdoor fan of claim 9, wherein the main plate unit is provided between a front end of the hub shaft and the plane of the side hole.

* * * * *